US005372868A

United States Patent [19]

Prewo et al.

[11] Patent Number: 5,372,868

[45] Date of Patent: Dec. 13, 1994

[54] FIBER REINFORCED GLASS MATRIX AND GLASS-CERAMIC MATRIX COMPOSITE ARTICLES

[75] Inventors: Karl M. Prewo, Vernon, Conn.; Otis Y. Chen, Tokyo, Japan; Martin J. Gibler, Manchester; Glenn M. Allen, Vernon, both of Conn.

[73] Assignee: United Technologies Corporation, Del.

[21] Appl. No.: 954,598

[22] Filed: Sep. 30, 1992

Related U.S. Application Data

[63] Continuation of Ser. No. 531,419, May 31, 1990, abandoned.

[51] Int. Cl.[5] ..... B32B 3/28; B32B 9/00

[52] U.S. Cl. ..... 428/167; 428/120; 428/166; 428/172; 428/178; 428/188; 428/228; 428/233; 428/238; 428/246; 428/257; 428/268; 428/366; 428/367; 428/368; 428/384; 428/401

[58] Field of Search ..... 428/178, 188, 244, 184, 428/187, 182, 174, 195, 384, 366, 367, 368, 167, 120, 172, 166, 228, 233, 238, 268, 401; 501/404, 409, 257, 246, 89, 95

[56] References Cited

U.S. PATENT DOCUMENTS

| | | | |
|---|---|---|---|
| 3,090,406 | 5/1963 | Koppelman | 139/184 |
| 3,965,942 | 6/1976 | Hatch | 428/257 |
| 4,314,852 | 2/1982 | Brennan et al. | 501/88 |
| 4,324,843 | 4/1982 | Brennan et al. | 428/697 |
| 4,428,763 | 1/1984 | Layden | 65/4.21 |
| 4,531,511 | 7/1985 | Hochberg | 126/430 |
| 4,786,304 | 11/1988 | Chen | 65/18.1 |
| 4,840,828 | 6/1989 | Böttger et al. | 428/257 |

OTHER PUBLICATIONS

Catalog: Woven Structures Division of Hitco.

*Primary Examiner*—Donald J. Loney

[57] ABSTRACT

Fiber reinforced glass or glass-ceramic matrix composite articles are described which comprise spaced apart face sheets connected by ribs which extend between the face sheets. The fibers in the ribs are interwoven with the fibers in the face sheets, thereby producing a structure having high shear strength.

20 Claims, 2 Drawing Sheets

FIBER REINFORCED GLASS MATRIX AND GLASS-CERAMIC MATRIX COMPOSITE ARTICLES

This application is a continuation of application Ser. No. 07/531,419 filed on May 31, 1990, now abandoned.

TECHNICAL FIELD

This invention relates to fiber reinforced glass matrix and glass-ceramic matrix composite articles.

Background Art

Fiber reinforced glass matrix and glass-ceramic matrix composite articles are described in commonly assigned U.S. Pat. Nos. 4,314,852, 4,324,843, 4,428,763 and 4,786,314, which are incorporated herein by reference. As these types of fiber reinforced composite articles gain acceptance in the aerospace and automotive industries, designers of products produced by such industries demand composite articles with even further improved properties. This invention satisfies such demands.

Summary of the Invention

According to this invention, a fiber reinforced composite article is characterized by opposing face sheets having ribs which extend between the face sheets, wherein the ribs and face sheets are comprised of woven nonmetallic fibers in a glass or glass-ceramic matrix, and the fibers in the ribs are woven with the fibers in the face sheets.

In a preferred embodiment of the invention, the woven fibers which comprise the face sheets and ribs extend continuously through each rib, back and forth from one face sheet to the other face sheet.

The stress rupture and elastic modulus of fiber enforced composite articles in accordance with the invention is comparable to, or better than, similarly shaped articles fabricated from metals. Further, the density of articles of this invention is generally about one third to one half the density of metal articles having the same high temperature stability.

Other advantages and features of the invention will be apparent from the following description of the best mode for carrying out the invention, read in light of the drawings.

BEST MODE FOR CARRYING OUT THE INVENTION

Figure 1:
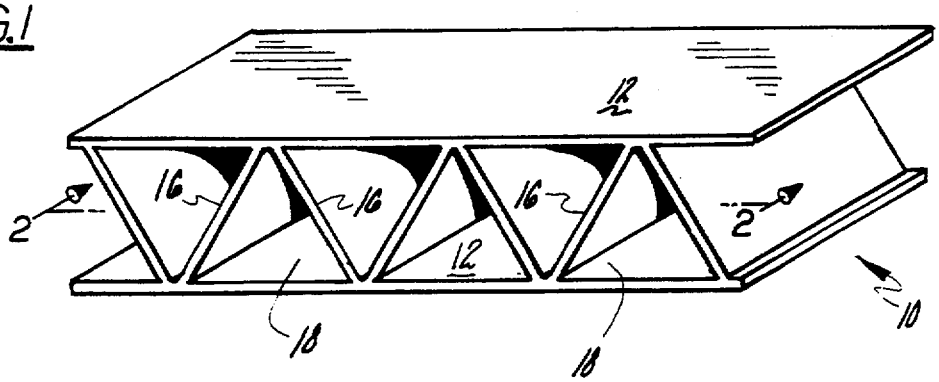
FIG. 1 is a perspective view of a fiber reinforced composite article according to this invention.

A fiber reinforced article in accordance with the present invention is shown in FIG. 1, and is represented by the general reference numeral 10. The article 10 comprises face sheets 12 which are spaced apart from each other and in opposing relation to each other. Extending between the face sheets 12 is one or more ribs or trusses 16. Because of its shape, the article of this invention is referred to herein as a fiber reinforced truss panel or, more simply, a truss panel. The rids 16 and face sheets 12 define cells 18. The cells 18 in FIG. 1 have a triangular cross section; cells having other cross sectional shapes (rectangular, curvilinear, etc.) are within the scope of the invention. Also within the scope of the invention are truss panels characterized by cells having different shapes and sizes. In other words, the cells in the truss panel do not all have to have the same cross sectional size or shape.

The face sheets and ribs which characterize the truss panel of this invention are comprised of nonmetallic fibers in a glass or glass-ceramic matrix; glass matrices include borosilicate, aluminosilicate, and high silica glass; glass-ceramic matrices include lithium aluminosilicate, magnesium aluminosilicate, barium magnesium aluminosilicate, calcium aluminosilicate, barium aluminosilicate, and barium lithium aluminosilicate. For purposes of this invention, glass matrices can include mixtures of the aforementioned glass types, and glass-ceramic matrices can include mixtures of the aforementioned glass-ceramic types as well as mixtures of the glass and glass-ceramic types.

Figure 2:
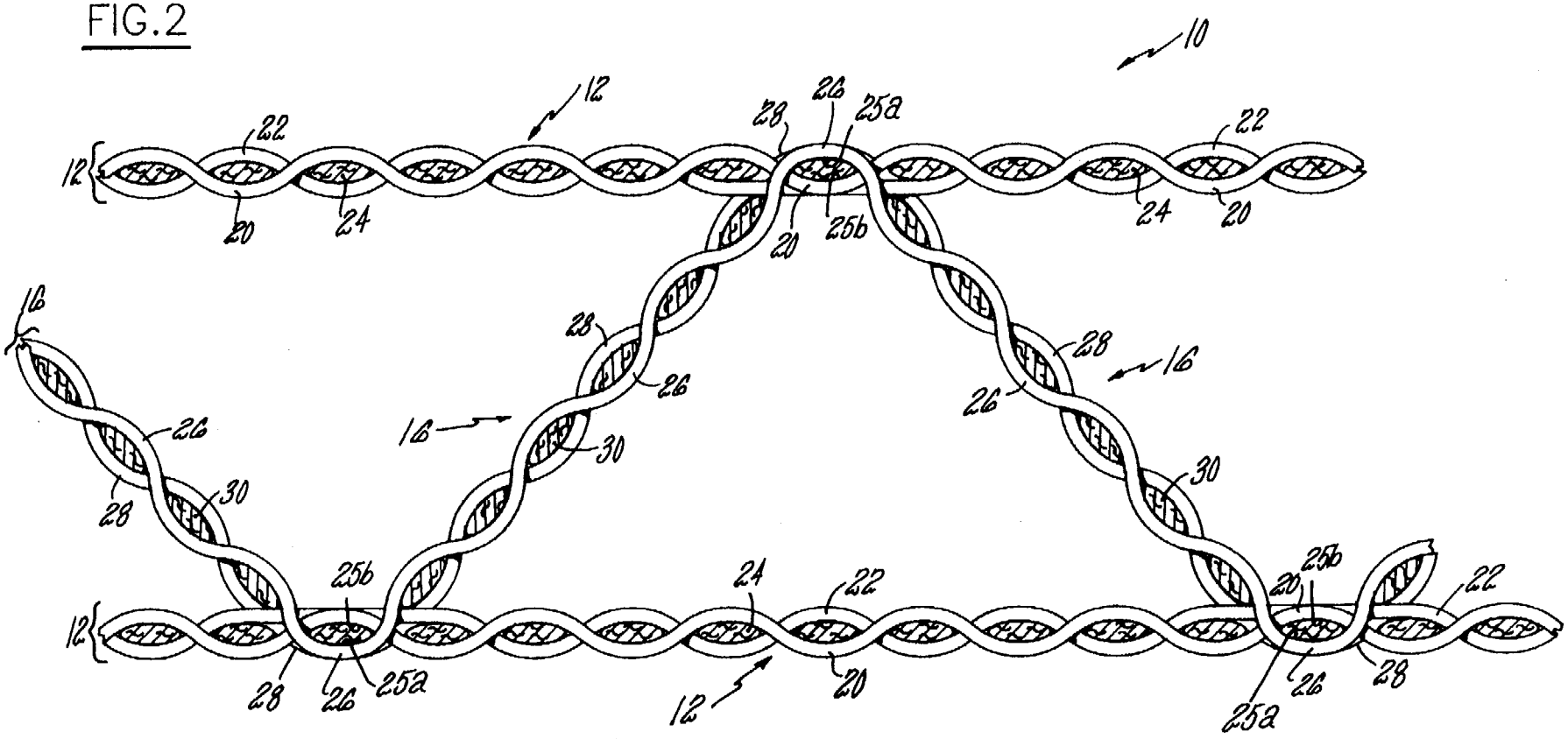
FIG. 2 is a schematic, cross sectional view along lines 2—2 of FIG. 1, showing the manner in which the fibers in the face sheets and ribs are woven with each other.

The fibers in the face sheets 12 and in the ribs 16 are woven with each other, as schematically shown in FIG. 2. In FIG. 2, warp fibers 20 and 22 are interlaced with fill fibers 24 to form face sheets 12. Similarly, warp fibers 26 and 28 are interlaced with fill fibers 30 to form ribs 16. Finally, the rib warp fibers 26, 28 are interlaced with the face sheet warp and fill fibers 20, 22 and 24, respectively, at the intersection of each rib 16 and face sheet 12.

FIG. 2 shows that the warp and fill fibers in the ribs 16 and face sheets 12 are interlaced in a regular, plain weave pattern, i.e., warp fibers pass over and under alternate fill fibers in a sinusoidal pattern. Other weave patterns may be used; for example, a pattern in which two warp fibers are interlaced with one fill fiber. The woven structure should be 35–50%. fiber by volume, preferably about 40% by volume.

FIG. 2 also shows that at the location where the rib warp fibers 26, 28 and the face sheet warp and fill fibers 20, 22, 24 are interlaced with each other, both of the rib warp fibers 26, 28 pass along the outwardly facing surface 25*a* of the face sheet fill fiber 24. The Figure also shows that the regular weave pattern of the face sheet warp fibers is slightly modified at said location; the face sheet warp fiber 22 which would normally pass over the outwardly facing surface 25*a* of the fill fiber 24 (according to the plain weave, sinusoidal pattern) instead passes along the inwardly facing surface 25*b* of the face sheet fill fiber.

Preferably, the fibers in the truss panel 10 extend from one face sheet, through each rib, to the other face sheet. Even more preferably, the fibers extend continuously through each rib, back and forth from one face sheet to the other face sheet.

The interweaving between the fibers in the face sheets and ribs results in a structure having vastly superior shear strength as compared to fiber reinforced composite articles described by the prior art. The shear strength of prior art articles, measured at the joints between the ribs and face sheets, is generally equal to the shear strength of the matrix material, because the fibers do not extend between the ribs and face sheets;

and because the matrix is generally a brittle material, shear strength is low. The shear strength of truss panels made in accordance with this invention is generally equal to the combined shear strength of the matrix material and the woven fiber structure.

Fibers used in carrying out this invention include multifilament yarns and fiber tows (i.e., collimated bundles of individual filaments). Useful yarns generally contain 250 to 12,000 individual filaments, each having an average filament diameter ranging between 5 and 20 microns. The diameter of yarn must be small enough so that it can readily be woven into complex shapes. Useful fiber tows are characterized by single or multiple tows of bundled individual filaments; the industry standard for fiber tows is 250 individual filaments per bundle; however, this invention is not to be construed as limited to such industry standard.

Preferable filament compositions include graphite, and carbides, borides, nitrides and oxides. Exemplary filament compositions are SiC, $TiB_2$, $Si_3N_4$ and TiN, and $Al_2O_3$. The filaments (whether they be in the form of yarn or fiber tows) may be impregnated with the glass or glass-ceramic matrix material prior to the weaving step.

As stated above, glasses which are useful as the matrix material include borosilicate, aluminosilicate and high silica glass; glass-ceramic matrices are the aluminosilicates. The matrix can also be a combination of glass and glass-ceramic materials.

The fiber reinforced composite article of this invention is made by the following steps, each of which is described in detail below: First, fiber (yarn or fiber tows) from two or more spools of such materials is woven to form the three dimensional truss panel of the type shown in FIG. 1. The fibers in the ribs are woven with the fiber in the face sheets; the weaving process is controlled so that the desired cell pattern is achieved as well as the desired geometry of the structure.

After weaving, the woven structure is impregnated with the desired matrix material. The first step in this process is to place one or more rigid inserts into each of the cells to expand the weaving into the three dimensioned shape which is desired of the fully processed truss panel. The inserts are made from a material with sufficient properties to withstand the temperatures and stresses of the impregnation process; suitable materials include graphite, ceramic and metal.

Figure 3:
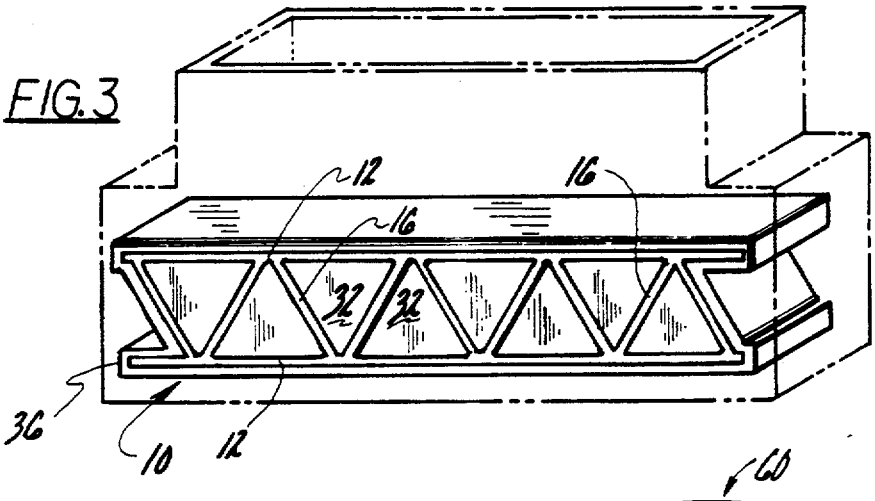
FIG. 3 is a perspective view showing an apparatus (in phantom) used in the production of articles of this invention.

As is shown in FIG. 3, with the inserts 32 in place, the woven structure 10 is placed into a mold (shown in phantom outline) having a cavity 36 approximately sized to accept the structure 10. Then, a billet (or powder mass) of the glass or glass-ceramic matrix is heated above its flow temperature and transferred into the cavity 36 by conventional processes, to infiltrate the woven network of fibers. The transfer direction is preferably transverse to the thickness of the structure. After the matrix material has been transferred into the mold cavity 36, the mold 34 and its contents are cooled, preferably to room temperature, during which the matrix material solidifies. The inserts 32 are then removed from the structure (e.g., by leaching or machining). If the matrix material is a glass-ceramic material, the panel is heat treated to partially or fully crystallize the matrix. Crystallization of the matrix significantly improves strength, elastic modulus and other mechanical properties. Finally, the truss panel is machined, if necessary, into its desired geometry.

The most preferred combination of fiber and matrix material depends on the anticipated use of the truss panel. For uses up to about 430° C., graphite fiber in a borosilicate glass matrix is preferred; for uses up to about 650° C., silicon carbide or aluminum oxide fiber in a borosilicate glass matrix is preferred; for uses up to about 1,100° C., silicon carbide or aluminum oxide fibers in a lithium aluminosilicate glass matrix is preferred; and for uses over 1,100° C., the matrix is preferably barium aluminosilicate. Other combinations of fiber and matrix material may also be used, as the application requires. For example, calcium aluminosilicate and barium magnesium aluminosilicate matrices may be used up to 1,300° C.; barium aluminosilicate matrices may be used up to 1,500° C.

Typically, the diameter of the fibers in the ribs 16 is the same as the diameter of the fibers in the face sheets 12. The properties of the truss panel of this invention may be further tailored by using a combination of fibers having different diameters. For example, it is within the scope of this invention to use fibers having diameters of 8 and 15 microns in the face sheet, but only the 8 micron diameter fibers in the ribs. Monofilament fibers having relatively large diameters (in the range of 75–200 microns) may be incorporated into the fill fibers at selected locations in the truss panel in order to modify the properties of the panel. The composition of the fibers in the ribs 16 is typically the same as the composition of the fibers in the face sheets 12. Variations in properties may be obtained by using several compositions of fibers in the truss panel. For example, silicon carbide and aluminum oxide fibers may be used in the face sheets, with only silicon carbide fibers used in the ribs.

Composite articles made in accordance with this invention have utility in the aerospace industry. For example, their density (about 2.4 grams/cubic centimeters ($g/cm^3$)) is significantly less than the density of nickel alloy components (about 8.1 $g/cm^3$) as well as titanium alloy components (about 4.6 $g/cm^3$). Stress rupture properties of components in accordance with the invention are equal to or better than those of metal alloy components, and their elastic modulus is less. Thermal fatigue properties and specific stiffness of the invention articles are also superior to metal alloy components.

Figure 4:
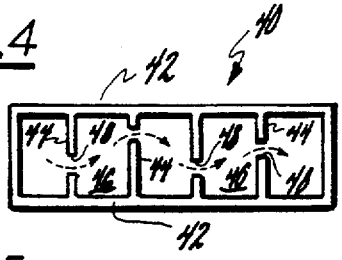
FIG. 4 is a cross sectional view through an embodiment of the invention.

FIG. 4 shows an embodiment of the invention useful in applications which require fluid transfer. FIG. 4 is a cross sectional view through a truss panel having a configuration similar to the panel shown in FIG. 1, but with rectangular cross sectional shaped cells. In FIG. 4, the truss panel is indicated by the reference numeral 40 and the face sheets by reference numerals 42. The ribs 44 which extend between face sheets 42 define rectangular cross sectioned cells 46. A discontinuity 48 in the ribs 44 allows the cells 46 to be in fluid communication with each other. Such a feature is desired where the article is used in an environment in which, e.g., gaseous or liquid cooling is required to maintain the truss panel (or a component adjacent to it) at a desired temperature. Cooling medium is able to flow between the cells 46, as indicated by the arrows in the Figure, a result of the discontinuity 48 in the ribs 44. The discontinuity 48 is formed during the weaving process, or by a machining process subsequent to weaving or matrix infiltration.

In another embodiment of the invention, the cells are partially or completely filled with a material having a composition which is different from the matrix material, which modifies or enhances the properties of the truss panel. The addition of foamed materials to the cells, such as reticulated ceramic foams, can improve mechanical properties by, e.g., increasing the buckling resistance of the ribs. Thermal properties can be modified by the addition to the cells of materials which make the panel more conductive or insulative of heat. Electromagnetic properties can be tailored in the same manner, by adding materials to the cells which modify the electromagnetic properties of the panel.

Figure 5:
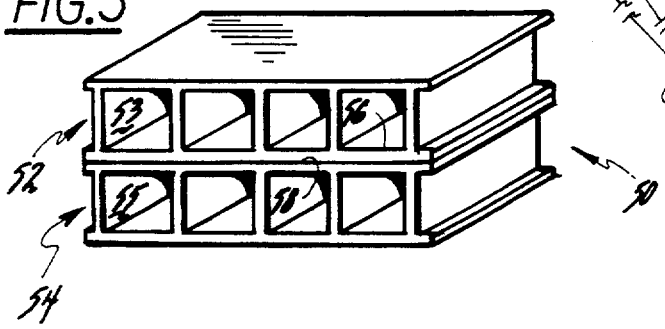

FIG. 5 shows an embodiment of the invention comprising an assembly 50 of two adjacent truss panels 52, 54. Adhesives such as particulate toughened ceramics may be used to bond the face sheets 56, 58 of the adjacent truss panels 52, 54, respectively, to each other. Mechanical means, such as clips, bolts and the like, may also be used to join the adjacent panel face sheets 56, 58. The cells 53, 55 in FIG. 5 run in parallel directions; however, the individual truss panels 52, 54 may be arranged such that the cells run in perpendicular or skewed directions if the applications requires such cell orientation. An interlayer may be placed between the adjacent face sheets 56, 58 to modify the properties of the assembly 50. The assembly truss panel configuration shown in FIG. 5 may also be obtained by weaving fibers in such a manner to form a singular, internal face sheet rather than plural face sheets as shown in FIG. 5; in such case, the fibers in the ribs are interlaced with the fibers in the face sheets.

Figure 6:
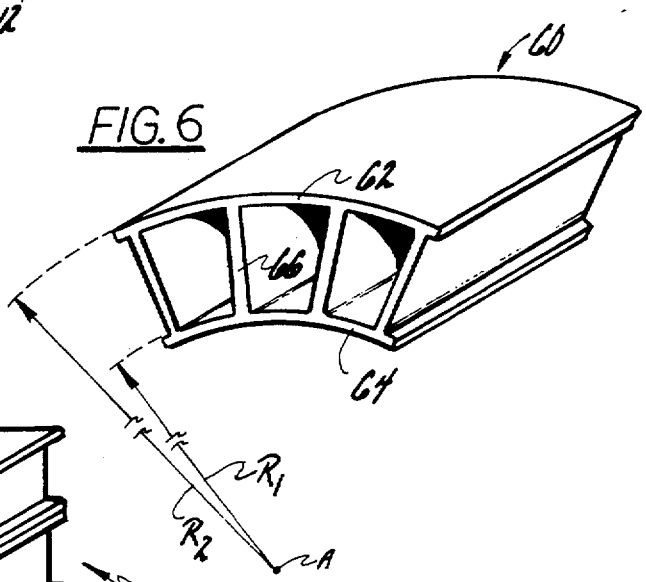
FIG. 5 and 6 are perspective views showing embodiments of the invention.

Even though the embodiments described above are shown as having face sheets which are both flat and parallel to each other, some curvature and/or skewness of the face sheets is possible, as shown in FIG. 6. In FIG. 6, the face sheets 62 and 64 are curved, having a radius of curvature $R_1$ and $R_2$, respectively about a common axis A. Ribs 66 extend radially between the face sheets 62, 64, and the rib fibers are interwoven with the face sheet fibers. Truss panels 60 of the type shown in FIG. 6 are useful in rotary machines such as gas turbine engines.

As an example of this invention, a fiber reinforced glass-ceramic matrix truss panel having cells with a triangular cross section is formed by weaving silicon carbide yarn having a nominal 12 micron diameter into a shape similar to that shown in FIG. 1. After weaving, graphite inserts having a triangular cross section are placed into each one of the cells. The weaving is placed into a cavity of a graphite mold and then a billet of lithium aluminosilicate glass-ceramic is heated to about 1,300° C. and then forced into the mold cavity. After applying pressure for about 30 minutes, pressure is released and the mold allowed to cool. The truss panel is removed from the mold and the graphite inserts are removed. Finally, the composite is heat treated in argon to a temperature of about 1,100° C. for about 12 minutes to crystallize the matrix.

The fully finished composite has a wall thickness of about 0.18 mm and dimensions of about 12 cm (width)×30 cm (length)×1.8 cm (height). It is about 40% fiber by volume. Stress rupture life, measured at 875° C. is about 103 MPa, and elastic modulus is about 83 GPa. A component having the same dimensions but fabricated from the nickel base alloy known as Inconel Alloy 617 is about three times heavier than the invention truss panel, and has a stress rupture life of 62 MPa and an elastic modulus of about 160 GPa.

It should be understood that the invention is not limited to the particular embodiment shown and described herein, but that various changes and modifications may be made without departing from the spirit and scope of this invention as defined by the following claims.

What is claimed is:

1. A fiber reinforced glass matrix or glass-ceramic matrix article comprising first and second face sheets in opposing relation to each other, and a rib extending film the first face sheet to the second face sheet, wherein said face sheets and rib are comprised of woven nonmetallic fibers in said glass matrix or glass-ceramic matrix, and the fibers in the rib are woven with the fibers in the face sheets, said fibers selected from the group consisting of graphite, carbides, borides, nitrides and oxides.

2. The article of claim 1, comprising a plurality of ribs.

3. The article of claim 2, wherein the fibers in said ribs extend from said first face sheet to said second face sheet.

4. The article of claim 2, wherein said ribs and face sheets define cells, and the cells are partially or completely filled with a material having a composition which is different from the matrix material.

5. The article of claim 2, wherein said ribs and face sheets define cells, and adjacent cells are in fluid communication with each other.

6. The article of claim 2, wherein the composition of the fibers in said ribs is the same as the composition of the fibers in said face sheets.

7. The article of claim 2, wherein the diameter of the fiber in said ribs is the same as the diameter of the fibers in said face sheets.

8. The article of claim 2, wherein the matrix is one or more of the materials selected from the group consisting of borosilicate, aluminosilicate, high silica glass, lithium aluminosilicate, magnesium aluminosilicate, barium magnesium aluminosilicate, calcium aluminosilicate, and barium aluminosilicate.

9. The article of claim 2, wherein the fibers have a diameter between 5 and 20 microns.

10. The article of claim 2, wherein the fibers have a diameter between 8 and 15 microns.

11. A fiber reinforced glass matrix or glass-ceramic matrix composite article comprising spaced apart first and second face sheets and one or more ribs extending from the first face sheet to the second face sheet, said ribs and face sheets defining cells therebetween, wherein said ribs and face sheets are comprised of fibers in a glass matrix or glass-ceramic matrix, and the fibers extend from said first face sheet through said ribs to said second face sheet, and the fibers in said ribs are woven with the fibers in said face sheets, and wherein said fibers are one or more of the materials selected from the group consisting of graphite, aluminum oxide and silicon carbide and said matrix is one or more of the materials selected from the group consisting of borosilicate, lithium aluminosilicate and barium aluminosilicate.

12. The article of claim 11, wherein the fibers have a diameter between about 5 and 40 microns.

13. The article of claim 11, wherein the fibers are graphite and the matrix is borosilicate.

14. The article of claim 11, wherein the fibers are aluminum oxide or silicon carbide, and the matrix borosilicate.

15. The article of claim 11, wherein the fibers are silicon carbide or aluminum oxide, and the matrix is lithium aluminosilicate.

16. A fiber reinforced glass or glass-ceramic matrix article comprising first and second face sheets in opposing relation to each other, and a plurality of ribs extending from the first face sheet to the second face sheet, wherein said ribs and face sheets define cells and adjacent cells are in fluid communication with each other, and wherein said face sheets and ribs: are comprised of woven nonmetallic fibers in a glass or glass ceramic matrix, and the fibers in the ribs are woven with the fibers in the face sheets.

17. The article of claim 16, wherein the matrix is one or more of the materials selected from the group consisting of borosilicate, aluminosilicate, high silica glass, lithium aluminosilicate, magnesium aluminosilicate, barium magnesium aluminosilicate, calcium aluminosilicate and barium aluminosilicate.

18. The article of claim 16, wherein the fibers are one or more of the materials selected from the group consisting of graphite, carbides, borides, nitrides and oxides.

19. The article of claim 18, wherein the fibers have a diameter between 5 and 20 microns.

20. The article of claim 18, wherein the fibers have a diameter between 8 and 15 microns.

* * * * *